US005187320A

United States Patent [19]

Yunan

[11] Patent Number: 5,187,320

[45] Date of Patent: Feb. 16, 1993

[54] FIBRILLATABLE PTFE IN PLASTIC-BONDED EXPLOSIVES

[75] Inventor: Malak E. Yunan, Boonton Township, Morris County, N.J.

[73] Assignee: E. I. Du Pont de Nemours and Company, Wilmington, Del.

[21] Appl. No.: 803,442

[22] Filed: Dec. 6, 1991

[51] Int. Cl.[5] ..... C06B 45/10

[52] U.S. Cl. ..... 102/275.8; 149/19.8; 149/19.92; 149/19.3

[58] Field of Search ..... 149/19.8, 19.92, 19.3; 102/275.8

[56] References Cited

U.S. PATENT DOCUMENTS

| | | | |
|---|---|---|---|
| 3,407,731 | 10/1968 | Evans | 149/19.8 |
| 3,764,420 | 10/1973 | Sayles | 149/19.8 |
| 3,943,017 | 3/1976 | Wells | 179/19.8 |
| 3,993,584 | 11/1976 | Owen et al. | 252/383 |
| 4,014,720 | 3/1977 | Wells | 149/98 |
| 4,232,606 | 11/1980 | Yunan | 102/275.8 |
| 4,878,431 | 11/1989 | Herring | 102/290 |
| 5,019,232 | 5/1991 | Wilson et al. | 204/182.8 |
| 5,030,667 | 7/1991 | Shimizu et al. | 523/201 |

*Primary Examiner*—Edward A. Miller
*Attorney, Agent, or Firm*—Charles E. Krukiel

[57] ABSTRACT

An improved plastic-bonded explosive composition which includes from 2 wt. % up to 30 wt. % of a nitrocellulose binder and comprises incorporating into the composition during preparation from about 0.0025 wt. % up to a value less than 2 wt. % of fibrillatable polytetrafluoroethylene (PTFE) and mixing the composition thoroughly and with sufficient shearing action whereby the PTFE fibrillates and becomes substantially uniformly distributed throughout the finished composition.

7 Claims, No Drawings

FIBRILLATABLE PTFE IN PLASTIC-BONDED EXPLOSIVES

BACKGROUND OF THE INVENTION

The present invention relates to plastic-bonded explosive (PBX) compositions, and, more particularly, to an improvement in such PBX compositions which comprises incorporating therein from about 0.0025 wt. % up to a value of less than 2 wt. % of fibrillated polytetrafluoroethylene (PTFE) whereby the coherency of the resulting composition is enhanced, and the resulting formulation is extrudable and formable into desired shapes, such as, for example detonating cords. The present invention is particularly useful in improving the extrudability and formability of PBX formulations in which the nitrocellulose component is a non-dynamite grade, i.e., low-viscosity grade, nitrocellulose. The present invention also relates to a process for improving the tensile strength and the elongation properties of such PBX compositions in which a grade of nitrocellulose other than dynamite grade nitrocellulose is employed as a binding agent which comprises incorporating into the composition from about 0.0025 wt. % up to a value less than 2 wt. % of fibrillatable PTFE, and then mixing the composition with sufficient shearing action to fibrillate the PTFE and distribute it uniformly throughout the finished composition.

Nitrocellulose of a "high" viscosity is normally required when forming PBX compositions, as described, for example, in U.S. Pat. Nos. 2,992,089; 3,317,361; 3,400,025; and 3,943,017. Such "high" viscosity nitrocellulose is commonly referred to as "dynamite grade nitrocellulose" or "blasting soluble nitrocellulose" in contrast to industrial nitrocellulose grades which are inherently weaker because of a lower relative tensile strength and bonding strength. The coherency of PBX compositions, i.e., formulations, which are based on a non-dynamite grade nitrocellulose, makes them generally not formable into useful explosive products using conventional pressing, molding, sheet forming, and extrusion techniques.

It has now been found according to the invention that PBX products can be successfully formulated with non-dynamite grade nitrocellulose when fibrillated PTFE resin is uniformly distributed throughout the composition.

SUMMARY OF THE INVENTION

The present invention is an improvement in a PBX composition of the type which consists essentially of a crystalline high explosive compound and from about 2 wt. % to about 30 wt. % of a nitrocellulose binder, the improvement comprising incorporating into the composition from about 0.0025 wt. % up to a value less than 2 wt. % of fibrillated PTFE whereby the tensile strength of the finished composition is improved. The present invention provides a plastic-bonded explosive composition consisting essentially of:

(a) from about 44 wt. % up to about 90 wt. % of a crystalline high explosive compound having a maximum particle dimension within the range of 0.1 and 50 micrometers, the average particle dimension being no greater than about 20 micrometers;

(b) from about 2 wt. % up to about 14 wt. % of a nitrocellulose binder having a nitrogen content in the range of from 10% to 14%;

(c) from about 15 wt. % up to about 35 wt. % of a plasticizer; and (d) from about 0.0025 wt. % up to a value which is less than 2 wt. % of fibrillated PTFE.

Fibrillatable PTFE, useful according to the invention, is any "Teflon" fluorocarbon resin, such as, for example, "Teflon" K, which is capable of forming microscopic to submicroscopic fibers or strands when worked vigorously, i.e., mixed homogeneously under high shear. High shear mixing action causes fiber formation and then aids in distributing the fibers throughout the explosive composition. The fibers of PTFE then tend to interlock and add strength to the resulting mixture.

The present invention according to another aspect is a method for improving the tensile strength and elongation characteristics of an explosive composition of the type which comprises a plastic-bonded explosive and from about 2 wt. % to about 30 wt. % of industrial grade nitrocellulose binder which is not dynamite grade nitrocellulose in which the method comprises adding to the explosive composition during preparation from about 0.0025 wt. % up to a value which is less than 2 wt. % of fibrillatable PTFE, and mixing the composition thoroughly and with sufficient shearing action whereby the PTFE will fibrillate and become substantially uniformly distributed throughout the finished composition. Thereafter, the composition can be formed by extruding, rolling, or other means into cords, rods, sheets and other shapes as desired. The formed composition can then be processed into final products, such as, for example, detonators, initiators, downlines, trucklines, boosters, cutting charges and shaped charges.

According to yet another aspect, the invention is an improved low energy detonating cord of the type which includes a cap-sensitive crystalline high explosive compound selected from the group consisting of organic polynitrates and polynitramines admixed with a nitrocellulose binding agent which is not dynamite grade nitrocellulose. The improvement comprises incorporating into the admixture of explosive compound and nitrocellulose binding agent from about 0.0025 wt. % up to a value which is less than 2 wt. % of fibrillatable PTFE and thoroughly mixing it with sufficient shearing action that the PTFE fibrillates and becomes distributed uniformly throughout the explosive mixture.

DETAILED DESCRIPTION OF THE INVENTION

As described in greater detail in U.S. Pat. No. 2,992,087, the teachings of which are incorporated herein by reference, dynamite grade nitrocellulose is the term used to differentiate a generally high viscosity nitrocellulose having an average degree of polymerization within the range of 2000 and 3000 from non-dynamite grades of nitrocellulose. Dynamite grade is also known as a "soluble type" nitrocellulose and has a nitrogen content of from about 7% up to about 13%.

Alternative grades of nitrocellulose are generally of higher quality than dynamite grade nitrocellulose, but they do not posses the same physical characteristics, i.e., generally they tend to be weaker and are not capable of imparting the same or equivalent tensile strength and elongation properties to the nitrocellulose-based explosive composition of which they are a component. When dynamite grade nitrocellulose is not available, therefore, it becomes necessary to employ an additive which is compatible with the other ingredients of the composition and which resists degradation over long storage periods.

PBX formulations to which the invention is particularly applicable comprise from about 44 wt. % up to about 90 wt. % of a crystalline high explosive, such as, for example, PETN, RDX, HMX, and mixtures thereof. The explosive is combined with from about 2 wt. % up to about 14 wt. % of nitrocellulose and from about 15 wt. % up to about 35 wt. % of a plasticizer for the nitrocellulose. Suitable plasticizers include, for example, the trialkyl esters of 2-acetoxy-1,2,3-propanetricarboxylic acid wherein each alkyl group contains from 2 to 8 carbon atoms, dioctyl sebacate, triethylene glycol di(2-ethylbutyrate), trimethylolethane trinitrate (TMETN) and other similar materials. PBX formulations are prepared typically by:

(a) combining the crystalline high explosive with the nitrocellulose;
(b) adding the plasticizer for the nitrocellulose to the combination; and then
(c) adding from about 0.0025 wt. % up to a value less than 2 wt. % of fibrillatable PTFE, although the PTFE can be added to the formulation at any convenient point in the preparation; and
(d) mixing the ingredients thoroughly with sufficient shearing action to fibrillate the PTFE and distribute it throughout the composition.

Thereafter, the formulation can be formed by rolling, extruding or other convenient means into cords, rods, sheets and other shapes for final processing.

The crystalline high explosive and the nitrocellulose are normally wetted with water and an antifreeze solvent (alcohol) to decrease hazards in storage, handling, and processing.

The order of addition of the components is not critical, and the composition may be mixed by any procedure that is consistent with the processing of plastic-bonded explosives, such as by dry processing or wet processing. The temperature of mixing is not critical, although temperature may be elevated as desired to remove excess water from the composition.

It is essential, after addition of the PTFE, that the composition be mixed thoroughly with sufficient shearing action to fibrillate the PTFE throughout the composition. Methods for fibrillating PTFE which can also be used practicing this invention are discussed in U.S. Pat. No. 3,838,092, the teachings of which are incorporated herein by reference.

Crystalline high explosives particularly useful for forming PBX to be used in applications such as detonating cord are PETN, RDX, and HMX. For use as low-energy detonating cord, the particles of the crystalline high explosive should have their maximum particle dimension in the range of from about 0.1 to 50 micrometers, the average maximum particle dimension generally being no greater than about 20 micrometers, because the smaller the explosive particles the more sensitive the explosive is to propagation. Preparation of such finely divided high explosives is disclosed in U.S. Pat. No. 3,754,061, the teachings of which are incorporated herein by reference.

As is realized by those skilled in the art, the explosive content of PBX is a function of the crystalline high explosive, the shape into which the PBX is formed, and the purpose and requirements of the product into which it is formed. In the present invention the amount of explosive can vary from a low of about 44% to up to about 90%.

Non-dynamite grade nitrocelluloses include both nitrocellulose made for use in explosives as well as industrial nitrocelluloses made for use in coating applications. Nitrocelluloses with a nitrogen content in the range of about 10 to about 14 are contemplated for use according to the invention.

Plasticizers compatible with nitrocellulose and suitable for use in PBX include the trialkyl esters of 2-acetoxy-1,2,3-propanetricarboxylic acid, dioctyl sebacate, triethylene glycol di(2-ethylbutyrate), and other similar materials having pour points of −40° C. or below. When it is desired that the plasticizer be an explosively active ingredient, a liquid nitric ester, such as trimethylolethane trinitrate (TMETN), may be used as the plasticizer as described in greater detail in U.S. Pat. No. 3,943,017 the teachings of which are incorporated herein by reference.

Plasticizers particularly useful in PBX compositions with nitrocellulose, according to the invention, are the trialkyl esters of 2-acetoxy-1,2,3-propanetricarboxylic acid described in U.S. Pat. No. 2,992,087, the disclosure of which is incorporated herein by reference. Useful trialkyl esters include those wherein each alkyl group contains 2 to 8 atoms, such as the triethyl, tripropyl, tributyl, tripentyl, trihexyl, triheptyl esters and their isomers, as well as tri(2-ethylhexyl). The tributyl ester, referred to as acetyl tributyl citrate, is particularly preferred because it does not adversely affect the crystalline high explosive.

Additives for explosive compositions known in the art to impart characteristics such as increased efficiency, camouflage, stability, and detectability may be added to the plastic-bonded explosives of this invention as long as the performance of the composition is not adversely effected.

Polytetrafluoroethylene (PTFE) is a polymeric fluorocarbon resin. As used throughout this specification, "fibrillatable PTFE" refers to those types of PTFE that will fibrillate, that is, under conditions of working by mixing to impart a shearing action, the PTFE particles will form a network of fibers throughout the composition with which they are mixed. The type of PTFE known as fine powders or as coagulated dispersions readily fibrillate and are preferred in the compositions of the present invention. The fine powders are actually agglomerates of PTFE particles which have an average size of about 275 to 855 micrometers. Fine powders are defined by ASTM D-4895-89. Fibrillatable PTFE may be used as a dry powder or as an aqueous dispersion. Aqueous dispersions of fibrillatable PTFE also readily fibrillate and are defined by ASTM D-4441. These dispersions may contain surfactants. In aqueous dispersions the PTFE particles are not agglomerated, and the average particle size is about 0.05 to 0.5 micrometers. Aqueous dispersions may be used in the composition of the present invention as long as the performance of the final composition is not adversely effected by any surfactant that may be present.

EXAMPLES

Superfine PETN as used herein in the following examples is characterized as having a maximum particle dimension within the range of 0.1 and 10 micrometers, the average maximum particle dimension being within the range of 0.1 and 2 micrometers.

"Teflon" K-20 is a fibrillatable PTFE product manufactured and available from E. I. du Pont de Nemours and Company, Wilmington, Del. It is an aqueous suspension of fluorocarbon particles. The suspended particles are negatively charged, ranging in size from 0.05 to 0.5 micrometers. Active ingredients are a nominal 33% by weight, and the suspension is stabilized with approximately 1% by weight of a nonionic surfactant.

EXAMPLE 1

Each of the nitrocelluloses listed in Table I was mixed according to the following procedure both with and without Teflon K-20; thus, 10 batches were mixed.

A slurry coat was prepared by adding 37 g, dry basis, of water/alcohol wet superfine PETN (about 30% solids) to a 250 mL beaker containing 150 mL of water while the beaker was stirred at about 150 RPM by a small electric impeller. After 2 minutes of stirring, 2.5 g, dry basis, of water/alcohol wet nitrocellulose (about 30% solids) was added to the stirred slurry. Two minutes after the addition of nitrocellulose, 10.5 g of acetyl tributyl citrate (ATC) was added slowly to the stirred slurry. The slurry coated PETN was stirred for 5 more minutes. For the slurry coated PETN mixes containing "Teflon" K-20, 0.125 g, dry basis, Teflon K-20 was added to the stirred slurry after the addition of the nitrocellulose.

After the five minutes of stirring, the slurry coated PETN was neutched (vacuum filtered) to remove about ⅔ of the total volume of water then dried in a vacuum oven at 160° F. to a moisture content of less than 0.3%. After drying, the slurry coat was kneaded in a small Atlantic Research Twin Cone Mixer (to provide kneading and shearing action) for 5 minutes and expelled from the mixer. The mixing and expelling operation was repeated 4 more times to assure homogeneity of the mix. The final product was a cohesive mass.

The product was extruded using a piston and a cylinder apparatus which could be equipped with different orifices or dies so that different diameter cords or different thickness of sheets could be extruded. Two cords, each 30 mil, were extruded. Prior to the second extrusion, the batch was remixed for about 20 minutes using the Twin Cone Mixer.

The procedure was repeated for Hercules 9000 Series nitrocellulose incorporating 1.0 g, dry basis, of "Teflon" K-20 instead of 0.125 g of "Teflon" K-20. The incorporation of ¼% PTFE into Hercules 9000 Series nitrocellulose did not result in a composition that was suitable for extrusion; thus the results of the Hercules 9000 Series with PTFE is based on the incorporation of 2% of PTFE. The Hercules 9000 Series was prepared for use by soaking and stirring the nitrocellulose in a water/alcohol/acetone mixture over night.

The experimental results for each nitrocellulose both with and without Teflon K-20 are shown in Tables II, III, and IV. For each batch two cords of 30 mil were extruded and tested for elongation and tensile strength. The cord extruded the second it was tested for its shooting reliability. Elongation results are given in Table II. Elongation of the cords was measured by attaching a piece of the cord to the jaws of a dial caliper and manually opening the caliper slowly until the cord broke. The elongation is reported as the percent (%) elongation.

Tensile strength results are given in Table III. Tensile strength was measured by attaching the cord to a tension meter using a spring type digital dial and manually pulling the cord until the cord broke. The tensile strength is reported in grams (g).

Shooting reliability of the cord was determined by coating the cord with a plastic oversleeve and shooting a 10 foot length of the coated cord as a detonating cord. The shooting reliability is reported as the number of feet which detonated. In general the shooting reliability improved by the addition of PTFE.

The explosive compositions of the Examples are particularly applicable for use in low-energy detonating cords of the type described in U.S. Pat. No. 4,232,606, the teachings of which are incorporated herein by reference.

EXAMPLE 2

Six production batches (150 pounds each) were mixed according to the following plant procedure. A slurry coat was prepared by stirring about 105 pounds, dry basis, of water wet superfine PETN into about 10,000 pounds of water in a tank equipped with a double bladed stirrer. After stirring for about 5 minutes, about 10 pounds, dry basis, of water/alcohol wet nitrocellulose (Hercules dynamite grade) was stirred into the tank. After about 5 more minutes, about 36 pounds of ATC (acetyl tributyl citrate) was gravity fed into the tank, over a period of about 20 minutes, after which mixing continued for 20 more minutes. For the batch containing "Teflon", about 3 ounces, dry basis, of "Teflon" K-20 was added prior to the addition of the ATC. The slurry coated PETN was transferred to a neutching (vacuum filtering) tank and the water was removed to ⅓ content by weight, then was transferred to a centrifuge, and the water was removed to 1/6 water content by weight.

The slurry coated PETN was put in a steam heated Baker Perkins mixer and mixer for about 4 hours to a moisture content of less than 0.3%. In this process the nitrocellulose was masticated in the ATC to bind the PETN. The composition was analyzed by liquid chromatography; the composition for each batch is given in Table V.

Each batch was slugged into cylinders about 2.25 inches in diameter by a length of about 4 inches. Cords of 30 and 25 mil were extruded and tested for elongation and tensile strength as in EXAMPLE 1; the results are shown in Tables VI and VII. Elongation and tensile strength for the 23 and 21 mil cords was so low that it could not be accurately measured.

The mixes were extruded into detonating cords according to the methods of U.S. Pat. No. 4,369,688, the teachings of which are incorporated herein by reference. Three cords of each diameter, 21, 23, 25, and 30 mil were extruded then enclosed in a plastic sheath with multifilament yarns for reinforcement lying between the cord and sheath. The addition of Teflon to the mix improved the runability of the detonating cords. The shooting reliability (SR) results are given in Table VIII and are the average of the three cords for each diameter. The SR was calculated according to Equation I:

$$\frac{\text{Total no. of feet shot}}{0.2 \times \text{initial length of cord} \times \text{no. of shots}} \qquad \text{Equation I}$$

wherein,the initial length of cord was 2700 feet for the 30 and 25 mil cords, 1000 feet for the 23 mil cords, and 500 feet for the 21 mil cords.

TABLE I

List of nitrocelluloses used in Example 1.

NC1: Dynamite Grade

TABLE I-continued

List of nitrocelluloses used in Example 1.

Source: Hercules
% Nitrogen: 12.15–12.4
Viscosity: 20–99 seconds in a 4% solution*

NC2: dynamite Grade C.A.2
Source: Societe Nationale des Poudres et Explosifs
% Nitrogen (max): 12.6
Viscosity: 48 seconds**

NC3: RS 1000–1500
Source: Hercules
% Nitrogen: 11.8–12.2
Viscosity: 1000–1500 seconds in 12.2% solution^

NC4: Smokeless Series 2000 Grade A Type II
Source: Hercules
% Nitrogen: 12.45–12.70
Viscosity: 8–20 seconds in a 10% solution*

NC5: Smokeless Series 9000 Grade C Type II
Source: Hercules
% Nitrogen: 13.1–13.2
Viscosity: 9–15 seconds in a 10% solution*

*Viscosity was measured by a 5/16 inch steel ball falling 10 inches in a 1 inch diameter tube through a solution of specified nitrocellulose concentration in a solvent composed of 8 parts of acetone and 1 part ethyl alcohol.
**Method employed for viscosity determination was not available.
^ Viscosity in seconds as measured by a 3/32 inch diameter steel ball falling through a column of a solution of 12.2% nitrocellulose in a solvent composed, by weight, of 25 parts ethyl alcohol, 55 parts toluene, and 20 parts ethyl acetate.

TABLE II

Elongation results (%) for 30 mil cord for each nitrocellulose.

| | % | % |
|---|---|---|
| NC1 | 18.9 | 38.4 |
| NC1 + PTFE | 25.1 | 61.6 |
| NC1 + PTFE/NC1 | 1.33 | 1.60 |
| NC2 | 9.8 | 43.1 |
| NC2 + PTFE | 23.1 | 52.5 |
| NC2 + PTFE/NC2 | 2.36 | 1.22 |
| NC2 + PTFE/NC1 | 1.22 | 1.37 |
| NC3 | 6.9 | 24.1 |
| NC3 + PTFE | 25.7 | 49.7 |
| NC3 + PTFE/NC3 | 3.72 | 2.06 |
| NC3 + PTFE/NC1 | 1.36 | 1.29 |
| NC4 | 7.5 | 21.8 |
| NC4 + PTFE | 20.8 | 63.5 |
| NC4 + PTFE/NC4 | 2.77 | 2.91 |
| NC4 + PTFE/NC1 | 1.10 | 1.65 |
| NC5 | 9.2 | 14.8 |
| NC5 + PTFE | 17.0 | 19.8 |
| NC5 + PTFE/NC5 | 1.85 | 1.34 |
| NC5 + PTFE/NC1 | 0.90 | 0.52 |

TABLE III

Tensile Strength for 30 mil cord for each nitrocellulose. (Reported in g)

| | g | g |
|---|---|---|
| NC1 | 23.5 | 10.3 |
| NC1 + PTFE | 37.7 | 34.4 |
| NC1 + PTFE/NC1 | 1.52 | 3.34 |
| NC2 | 37.7 | 18.5 |
| NC2 + PTFE | 47.4 | 25.8 |
| NC2 + PTFE/NC2 | 1.26 | 1.39 |
| NC2 + PTFE/NC1 | 2.02 | 1.80 |
| NC3 | 17.3 | 15.0 |
| NC3 + PTFE | 48.9 | 31.1 |
| NC3 + PTFE/NC3 | 2.83 | 2.07 |
| NC3 + PTFE/NC1 | 2.08 | 3.02 |
| NC4 | 24.3 | 25.8 |
| NC4 + PTFE | 48.0 | 31.9 |
| NC4 + PTFE/NC4 | 1.98 | 1.24 |
| NC4 + PTFE/NC1 | 2.04 | 3.10 |
| NC5 | 9.5 | 12.7 |
| NC5 + PTFE | 25.1 | 30.3 |
| NC5 + PTFE/NC5 | 2.64 | 2.39 |
| NC5 + PTFE/NC1 | 1.07 | 2.94 |

TABLE IV

Shooting Reliability fo 30 mil cord for each nitrocellulose. (Reported in feet)

| | |
|---|---|
| NC1 | 2 |
| NC1 + PTFE | 1 |
| NC2 | 7 |
| NC2 + PTFE | 10 |
| NC3 | 0.1 |
| NC3 + PTFE | 10 |
| NC4 | 1 |
| NC4 + PTFE | 10 |
| NC5 | 0.1 |
| NC5 + PTFE | 5 |

TABLE V

| | Composition (%) | | | |
|---|---|---|---|---|
| Batch | PETN | NC | ATC | PTFE |
| 1 | 68.8 | 8.1 | 23.0 | ⅛ |
| 2 | 67.8 | 8.2 | 24.0 | 0 |
| 3 | 68.9 | 6.6 | 24.5 | 0 |
| 4 | 68.9 | 7.0 | 24.1 | 0 |
| 5 | 70.6 | 4.6 | 24.8 | 0 |
| 6 | 73.4 | 4.4 | 22.2 | 0 |

TABLE VI

| | Elongation (%) | | | | | |
|---|---|---|---|---|---|---|
| Batch | 30 mil | 25 mil | 30 mil | 25 mil | 23 mil | 21 mil |
| 1 | 27 | 21 | 11 | 33 | 12 | 11 |
| 2 | 12 | 12 | 22 | 32 | 20 | x |
| 3 | 28 | 26 | 12 | 9 | x | x |
| 4 | 30 | 13 | x | 12 | 11 | 9 |
| 5 | 13 | 16 | 7 | 8 | 4 | x |
| 6 | 13 | 9 | 7 | 2 | 6 | x |

TABLE VII

| | Tensile Strength (g) | | | | | |
|---|---|---|---|---|---|---|
| Batch | 30 mil | 25 mil | 30 mil | 25 mil | 23 mil | 21 mil |
| 1 | 38 | 28 | 25 | 15 | 23 | 10 |
| 2 | 27 | 20 | 20 | 20 | 24 | x |
| 3 | 25 | 22 | 25 | 13 | x | x |
| 4 | 36 | 30 | x | 12 | 16 | 13 |
| 5 | 22 | 22 | 14 | 19 | 4 | x |
| 6 | 22 | 21 | 15 | 5 | 5 | x |

TABLE VIII

| | Shooting Reliability (SR) | | | |
|---|---|---|---|---|
| Batch | 30 mil | 25 mil | 23 mil | 21 mil |
| 1 | 10 | 10 | 8 | 6 |
| 2 | 10 | 2 | 0 | 0 |
| 3 | 10 | 10 | 5 | 0 |
| 4 | 10 | 10 | 8 | 0 |
| 5 | 10 | 8 | 7 | 1 |
| 6 | 10 | 10 | 10 | 2 |

We claim:

1. In a plastic-bonded explosive composition which consists essentially of a crystalline high explosive compound and from about 2 wt. % to about 30 wt. % of a nitrocellulose binder, the improvement comprising from about 0.0025 wt. % up to a value less than 2 wt. % of polytetrafluoroethylene (PTFE) uniformly distributed throughout said composition whereby the tensile strength of the finished composition is improved.

2. A method for improving the tensile strength and elongation characteristics of a plastic-bonded explosive which comprises a plastic-bonded explosive and from about 2 wt. % up to about 30 wt. % of nitrocellulose binder which has a nitrogen content of from about 7% up to about 14% in which the method comprises adding to the explosive composition during preparation from about 0.0025 wt. % up to a value less than 2 wt. % of fibrillatable PTFE and mixing the composition thoroughly and with sufficient shearing action whereby the PTFE will fibrillate and become substantially uniformly distributed throughout the finished composition.

3. An improved low energy detonating cord which includes a cap-sensitive crystalline high explosive compound selected from the group consisting of organic polynitrates and polynitramines admixed with a nitrocellulose binding agent which is not dynamite grade nitrocellulose, the improvement comprising from about 0.0025 wt. % up to a value of less than 2 wt. % of fibrillated PTFE uniformly distributed throughout the mixture.

4. The invention of claim 1 or claim 2 in which the nitrocellulose binder has a nitrogen content of from 10% up to 14%.

5. The invention of Claim 1, claim 2 or claim 3 in which the concentration of explosive is in the range of from 44 wt. % up to 90 wt. % and the explosive is selected from PETN, RDX, HMX and mixtures thereof.

6. The invention of claim 1 or claim 2 in which the nitrocellulose binder is non-dynamite grade nitrocellulose.

7. The invention of claim 5, in which the nitrocellulose binder is non-dynamite grade nitrocellulose.

* * * * *

UNITED STATES PATENT AND TRADEMARK OFFICE

CERTIFICATE OF CORRECTION

PATENT NO. : 5,187,320

DATED : February 16, 1993

INVENTOR(S) : Malak E. Yunan

It is certified that error appears in the above-indentified patent and that said Letters Patent is hereby corrected as shown below:

At column 8, line 61, in claim 1, insert --fibrillated-- between "of" and "polytetrafluoroethylene".

Signed and Sealed this

Seventeenth Day of June, 1997

Bruce Lehman

*Attest:*

BRUCE LEHMAN

*Attesting Officer*

*Commissioner of Patents and Trademarks*